United States Patent [19]

Baba

[11] Patent Number: 4,577,486

[45] Date of Patent: Mar. 25, 1986

[54] RETRACTING MECHANISM AND JAW ASSEMBLY FOR A POWER PRESS

[75] Inventor: Kiyokazu Baba, Komatsu, Japan

[73] Assignee: Kabushiki Kaisha Komatsu Seisakusho, Tokyo, Japan

[21] Appl. No.: 494,397

[22] Filed: May 13, 1983

[30] Foreign Application Priority Data

May 17, 1982 [JP] Japan ..... 57-70552[U]

[51] Int. Cl.[4] ..... B21D 43/02; B21D 43/10; B21D 43/13

[52] U.S. Cl. ..... 72/421; 72/422; 414/749

[58] Field of Search ..... 72/420, 421, 422, 419, 72/405; 414/749, 753

[56] References Cited

U.S. PATENT DOCUMENTS

| | | | |
|---|---|---|---|
| 2,901,126 | 8/1959 | Halberstadt | 414/753 |
| 3,178,040 | 4/1965 | Nelson | 72/419 |
| 3,921,820 | 11/1975 | Crockett | 414/753 |
| 4,189,269 | 2/1980 | Maier et al. | 414/753 |
| 4,272,981 | 6/1981 | Endter | 72/405 |
| 4,448,056 | 5/1984 | Baba | 72/422 |
| 4,449,390 | 5/1984 | Pontini | 72/422 |

FOREIGN PATENT DOCUMENTS

| | | | |
|---|---|---|---|
| 2121122 | 11/1971 | Fed. Rep. of Germany | 72/422 |
| 2420936 | 11/1974 | Fed. Rep. of Germany | 72/422 |

*Primary Examiner*—Lowell A. Larson

*Attorney, Agent, or Firm*—Armstrong, Nikaido, Marmelstein & Kubovcik

[57] ABSTRACT

A jaw assembly is made retractable away from a power press in order to facilitate die change. A main carriage is cammed toward and away from the press dies in synchronism with the operation of the press. Mounted on the main carriage is a subcarriage which is also slidable toward and away from the press relative to the main carriage. The jaw assembly is mounted on the subcarriage. Thus, during die change, the jaw assembly can be held retracted away from the press as by a fluid actuated cylinder acting between the main and subcarriages. The jaw assembly typically comprises a pair of gripping jaws mounted on the piston rod of a fluid actuated cylinder on the subcarriage. When retracted, the jaw assembly does not interfere with the dies being changed.

1 Claim, 3 Drawing Figures

RETRACTING MECHANISM AND JAW ASSEMBLY FOR A POWER PRESS

BACKGROUND OF THE INVENTION

This invention relates to a retracting mechanism having a jaw assembly for gripping and taking a pressing out of press dies, such as those for drawing, in order to invert it, and more specifically to a retracting mechanism with provisions for retracting the jaw assembly away from the press during die change.

Some drawing presses in particular are equipped with a retracting mechanism which firstly withdraws the pressing out of the dies and then inverts it preparatory to delivery to subsequent processing stages. The retracting mechanism includes a jaw assembly for gripping and carrying the pressing out of the dies. In power presses providing for interchangeable use of a variety of die assemblies, the jaw assembly as heretofore built into the retracting mechanism has interfered upon a die assembly mounted on a moving bolster at a time when the die assembly together with the bolster is interchanged with another.

A conventional solution to the above problem has been to remove the jaw assembly from the retracting mechanism. This practice is objectionable as it adds to the period of time required for die change. The reduction of the die change period will contribute significantly to the improvement in the production of a press or a press line.

SUMMARY OF THE INVENTION

The present invention makes it possible to change die assemblies without removing the jaw assembly and so to shorten the period of die change.

Broadly the invention provides, in a retracting mechanism for a power press, apparatus comprising a main carriage reciprocated along guide means toward and away from the press. Mounted on the main carriage is a subcarriage which is also movable toward and away from the press relative to the main carriage. A jaw assembly is mounted on the subcarriage. Acting between the main carriage and the subcarriage, means such as a fluid actuated cylinder normally hold the subcarriage and therefore the jaw assembly thereon in a working position closer to the press relative to the main carriage and, for die change, move the sub-carriage to a retracted position away from the press relative to the main carriage.

Thus the removal of the jaw assembly is not necessary for die change; instead, the fluid actuated cylinder or the like may be activated to move the jaw assembly from the working to the retracted position together with the subcarriage relative to the main carriage. In the retracted position the jaw assembly does not interfere with a die assembly mounted on a moving bolster at a time when the die assembly together with the bolster is interchanged with another.

The above and other features and advantages of this invention and the manner of attaining them will become more apparent, and the invention itself will best be understood, from a study of the following description and the appended claims taken together with the attached drawings showing a preferred embodiment of the invention.

DESCRIPTION OF THE PREFERRED EMBODIMENT

Figure 1:
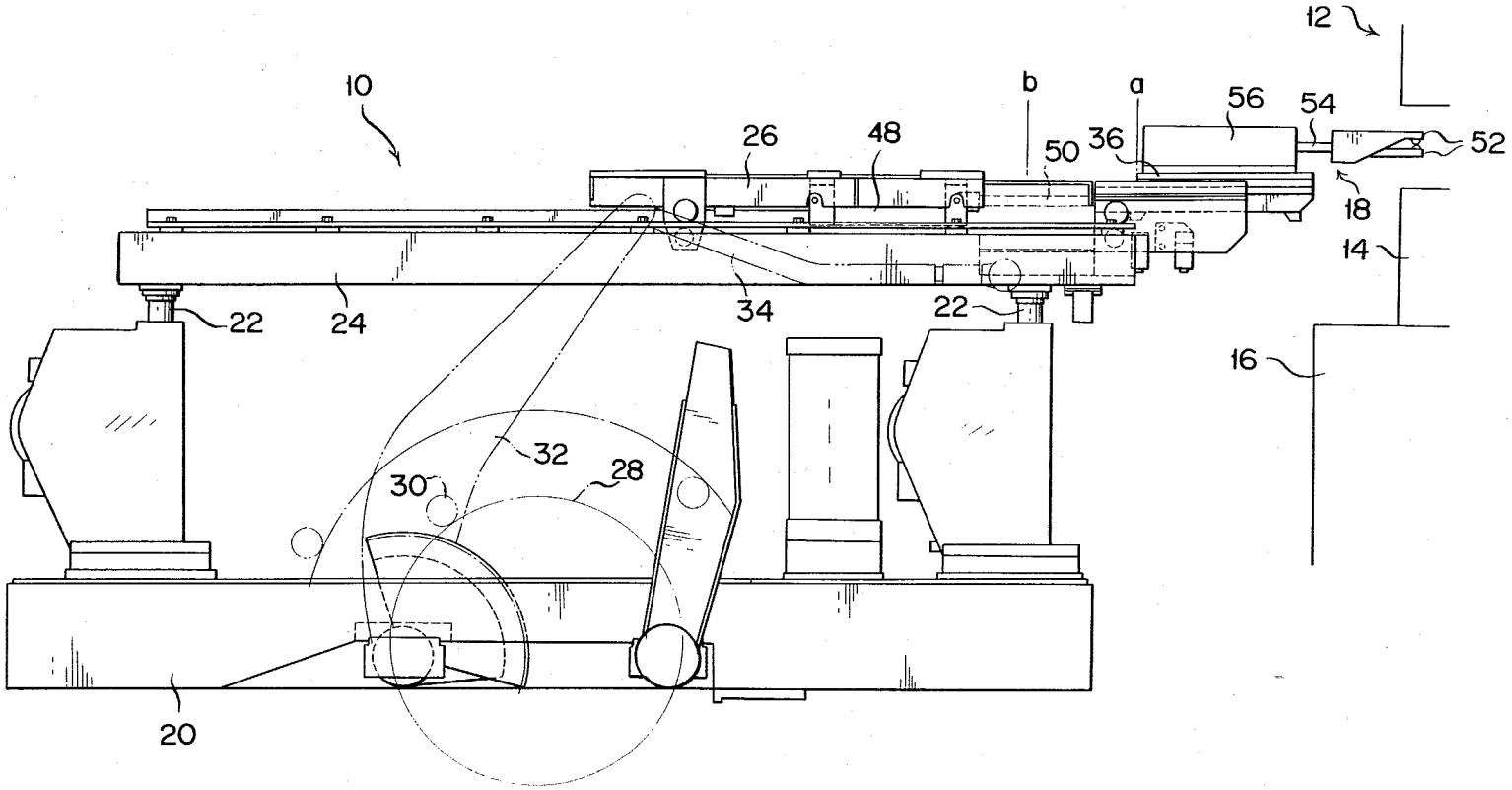
FIG. 1 is a side elevation of the apparatus embodying the principles of this invention.
Figure 2:
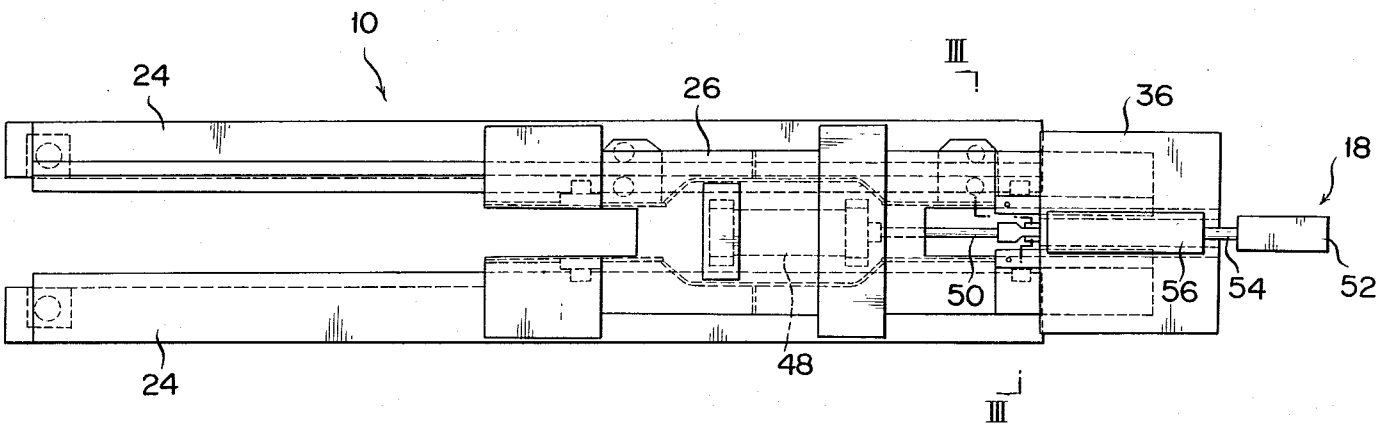
FIG. 2 is a top plan of the apparatus of FIG. 1.

The apparatus in accordance with the invention is generally designated 10 in FIGS. 1 and 2 and, in FIG. 1, is shown together with a press 12 having a die assembly 14 on a movable bolster 16. Disposed adjacent the press 12, the inventive apparatus 10 includes a jaw assembly 18 for gripping a pressing made by the press die assembly 14 and extracting it therefrom for the change of position thereof or turnover.

The reference numeral 20 in FIG. 1 denotes a platform on which there are erected a plurality of columns 22 for supporting thereon a pair of guide rails 24. As will be seen also from FIG. 2, these guide rails are arranged horizontally in parallel spaced relation to each other. A main carriage 26 is mounted on the guide rail pair 24 for rolling motion thereon toward and away from the press 12.

For reciprocating the main carriage 26 along the guide rail pair 24 there is provided a rotary cam 28 which is driven in synchronism with the operation of the press 12 by known means (not shown). A cam follower roll 30 makes rolling engagement with the cam 28. This cam follower roll is rotatably mounted on a lever 32 intermediate its opposite ends. The lever 32 has one of its ends pivoted on the platform 20 and the other end operatively coupled to the main carriage 26 via a link 34. Thus the rotation of the cam 28 results in the oscillation of the lever 32 and hence in the reciprocation of the main carriage 26 along the guide rail pair 24.

Figure 3:
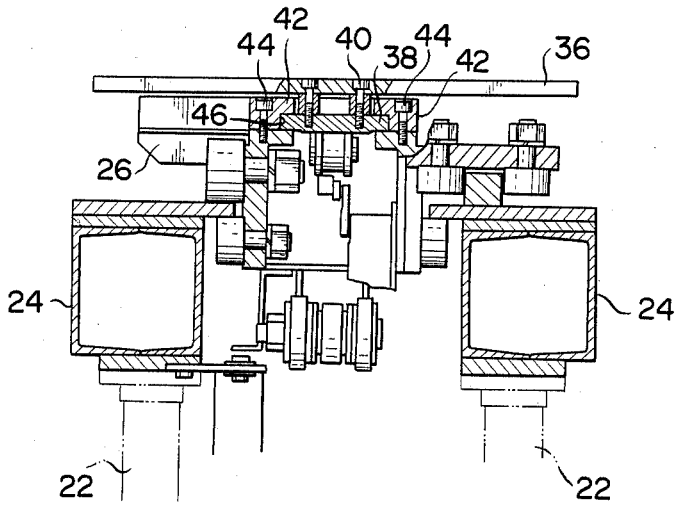
FIG. 3 is a section through the apparatus, taken along the planes of line III—III in FIG. 2.

Slidably mounted on the main carriage 26, at its end portion held opposite to the press 12, is a subcarriage 36 supporting the jaw assembly 18. As will be seen from its cross sectional view of FIG. 3, the subcarriage 36 is in the form of a flat plate disposed horizontally. It carries on its underside a slider plate 38 which is disposed centrally of the subcarriage with respect to its transverse direction and which is secured to the subcarriage as by threaded fastener elements 40 so as to be spaced a certain distance therefrom. A pair of elongate guide members 42 of L-shaped cross section are fastened at 44 to the main carriage 26 to define a pair of parallel spaced guide grooves 46 extending in the same direction as the guide rail pair 24. The slider plate 38 has its opposite lateral edges slidably engaged in the guide grooves 46, so that the subcarriage 36 is slidable on the main carriage 26 toward and away from the press 12.

With reference back to FIGS. 1 and 2 a fluid actuated cylinder 48 is mounted on the main carriage 26 in a position farther away from the press 12 than the subcarriage 36. The cylinder 48 has its piston rod 50 coupled to the subcarriage 36. Thus the cylinder 48 acts between main carriage 26 and subcarriage 36 to cause the linear sliding motion of the latter relative to the former.

The noted jaw assembly 18 is mounted directly on the subcarriage 36. As shown in FIGS. 1 and 2, the jaw assembly 18 comprises a pair of gripping jaws 52 operatively mounted on the piston rod 54 of a fluid actuated cylinder 56 immovably mounted on the subcarriage 36. One of the gripping jaws 52 is pivotable toward and away from the other, and they coact to grip the pressing formed by the die assembly 14 for extracting it therefrom.

Such being the construction of the apparatus 10 in accordance with the invention, the cylinder 48 is normally to be held extended for holding the subcarriage 36 projecting beyond the main carriage 26 and so for holding the jaw assembly 18 in the working position depicted in FIGS. 1 and 2. The letter a in FIG. 1 indicates the rear end position of the subcarriage 36 on the main carriage 26 when the jaw assembly 18 is in the forward working position. In this working position the jaw assembly 18 will perform its intended functions for the handling of the successive pressings in the known manner.

For die change, then, the cylinder 48 may be contracted to retract the subcarriage 38 together with the jaw assembly 18 thereon relative to the main carriage 26. The letter b in FIG. 1 denotes the rear end position of the retracted subcarriage 36 on the main carriage 26. Thus retracted, the jaw assembly 18 will not interfere with the die assembly 14 mounted on the movable bolster 16 at a time of the replacement of the die assembly 14 with another. The jaw assembly need not be removed from over the main carriage, so that the change of the die assemblies will be completed in a much shorter period of time than heretofore.

It will, of course, be understood that various changes may be made in the form, details, arrangements, and proportions of the parts without departing from the spirit or scope of the invention as expressed in the following claims.

What is claimed is:

1. A retracting mechanism for a power press including a die assembly and bolster comprising:

(a) guide means;

(b) a plurality of columns for supporting thereon said guide means;

(c) a main carriage movable along said guide means toward and away from the press;

(d) means for reciprocating the main carriage along said guide means in synchronization with the operation of the press;

(e) a subcarriage mounted on said main carriage for movement relative to same toward and away from the press;

(f) means for moving said subcarriage between a forward working position and a retracted position relative to said main carriage;

(g) a jaw assembly mounted on said subcarriage, said jaw assembly having a pair of gripping jaws and a fluid actuated cylinder fixedly mounted on said subcarriage for operating said gripping jaws; and (h) means for retracting said subcarriage independently of said means for reciprocating the main carriage, whereby said subcarriage may be retracted for purpose of changing said die assembly and bolster.

* * * * *